US010823526B2

(12) United States Patent
Zhu

(10) Patent No.: US 10,823,526 B2
(45) Date of Patent: Nov. 3, 2020

(54) AIR CYLINDER FOR PNEUMATIC GUNS

(71) Applicant: Zhongshan New Swan Technology Co., Ltd., Zhongshan (CN)

(72) Inventor: Zuopeng Zhu, Zhongshan (CN)

(73) Assignee: ZHONGSHAN NEW SWAN TECHNOLOGY CO., LTD., Zhongshan (CN)

( * ) Notice: Subject to any disclaimer, the term of this patent is extended or adjusted under 35 U.S.C. 154(b) by 409 days.

(21) Appl. No.: 15/869,111

(22) Filed: Jan. 12, 2018

(65) Prior Publication Data

US 2018/0135937 A1 May 17, 2018

Related U.S. Application Data

(63) Continuation-in-part of application No. PCT/CN2016/111650, filed on Dec. 23, 2016.

(30) Foreign Application Priority Data

Sep. 6, 2016 (CN) ..... 2016 2 1040811 U

(51) Int. Cl.

| | |
|---|---|
| ***F41B 11/64*** | (2013.01) |
| ***F41B 11/646*** | (2013.01) |
| ***F41B 11/68*** | (2013.01) |
| ***F41B 11/73*** | (2013.01) |
| ***F41B 11/723*** | (2013.01) |

(52) U.S. Cl.

CPC ..... *F41B 11/646* (2013.01); *F41B 11/68* (2013.01); *F41B 11/723* (2013.01); *F41B 11/73* (2013.01)

(58) Field of Classification Search

CPC ..... F41B 11/646; F41B 11/68; F41B 11/73; F41B 11/723; F41B 11/62

See application file for complete search history.

(56) References Cited

U.S. PATENT DOCUMENTS

2009/0084371 A1* 4/2009 Nibecker, Jr. ..... F41B 11/724 124/69

* cited by examiner

*Primary Examiner* — Abiy Teka

(74) *Attorney, Agent, or Firm* — Matthias Scholl P.C.; Matthias Scholl

(57) ABSTRACT

An air cylinder for pneumatic guns including a cylinder body. The cylinder body includes a side wall, a tubular air storage chamber, a piston capable of axially sliding along the side wall, an air charging hole, and an elastic member. The piston divides the air storage chamber into a first cavity and a second cavity. The air charging hole communicates with the first cavity. The elastic member is disposed in the second cavity and is capable of continuously pushing the piston towards the first cavity.

4 Claims, 3 Drawing Sheets

AIR CYLINDER FOR PNEUMATIC GUNS

CROSS-REFERENCE TO RELATED APPLICATIONS

This application is a continuation-in-part of International Patent Application No. PCT/CN2016/111650 with an international filing date of Dec. 23, 2016, designating the United States, now pending, and further claims foreign priority benefits to Chinese Patent Application No. 201621040811.5 filed Sep. 6, 2016. The contents of all of the aforementioned applications, including any intervening amendments thereto, are incorporated herein by reference.

BACKGROUND OF THE INVENTION

Field of the Invention

The present disclosure relates to the technical field of pneumatic guns, and, in particular, to an air cylinder for pneumatic guns.

Description of the Related Art

Conventional air cylinders for use in pneumatic guns have constant-volume, non-adjustable air storage chambers. When the firing is completed, the pressure of the compressed air drops to less than 70 bar, and the residual air in the chamber cannot be directly used for the next round. This leads to a relatively low compression efficiency.

SUMMARY OF THE INVENTION

In view of the technical problems mentioned above, it is one objective of the present disclosure is to provide an air cylinder for pneumatic guns, and the pneumatic guns comprising the same have relatively high air compression efficiency.

In accordance to one embodiment of the present disclosure, there is provided an air cylinder for pneumatic guns comprising a cylinder body. The cylinder body comprises a side wall, a tubular air storage chamber, a piston capable of axially sliding along the side wall, an air charging hole, and an elastic member; the piston divides the air storage chamber into a first cavity and a second cavity; the air charging hole communicates with the first cavity, and the elastic member is disposed in the second cavity and is capable of continuously pushing the piston towards the first cavity.

In a class of this embodiment, the elastic member is an air spring, one end of the air spring abuts against a bottom wall of the cylinder body, and the other end of the air spring abuts against the piston.

In a class of this embodiment, the elastic member is a compression spring, one end of the compression spring abuts against a bottom wall of the cylinder body, and the other end of the compression spring abuts against the piston.

In a class of this embodiment, the elastic member is compressed air, and the compressed air is sealed in the second cavity.

In a class of this embodiment, the cylinder body is a seamless steel tube, a front connecting shaft and a rear connecting shaft are respectively arranged in two end tube openings of the cylinder body, an O-shaped seal ring is arranged between the rear connecting shaft and the side wall of the cylinder body; the piston, the side wall of the cylinder body, the rear connecting shaft and the O-shaped seal ring collectively define the first cavity, the air charging hole is formed in the rear connecting shaft, the front connecting shaft is tightly plugged in the cylinder body, and the front connecting shaft, the piston and the side wall of the cylinder body collectively define the second cavity.

Advantages of the air cylinder for pneumatic guns in accordance with embodiments of the present disclosure are summarized as follows. The piston is disposed in the air storage chamber and capable of axially sliding along the side wall of the air storage chamber. The piston divides the air storage chamber into two independent cavities, and the elastic member is disposed in the second cavity and capable of continuously pushing the piston towards the first cavity. Due to this structure design, when the air storage chamber injects air outward, the compressed air in the air storage chamber can be completely exhausted and injected into a compressed air chamber of a pneumatic gun till the piston closely leans against the inner side of the rear connecting shaft, thereby largely improving the utilization rate of compressed air; when the air storage chamber is pressurized, the volume of the first cavity gradually increases till a set maximum pressure value is achieved; and meanwhile, during pressurization, the pressure of air entering the first cavity must be larger than a minimum pressure value (80 bar) of a set pre-pressure, so that the piston can be pushed to reversely slide and the elastic member is further compressed, thereby eliminating a procedure of pressurizing the air storage chamber from 0 bar to 80 bar, avoiding compressed air waste, and improving the effective utilization rate of the compressed air.

DETAILED DESCRIPTION OF THE EMBODIMENTS

For further illustrating the invention, experiments detailing an air cylinder for pneumatic guns are described below. It should be noted that the following examples are intended to describe and not to limit the invention.

Figure 1:
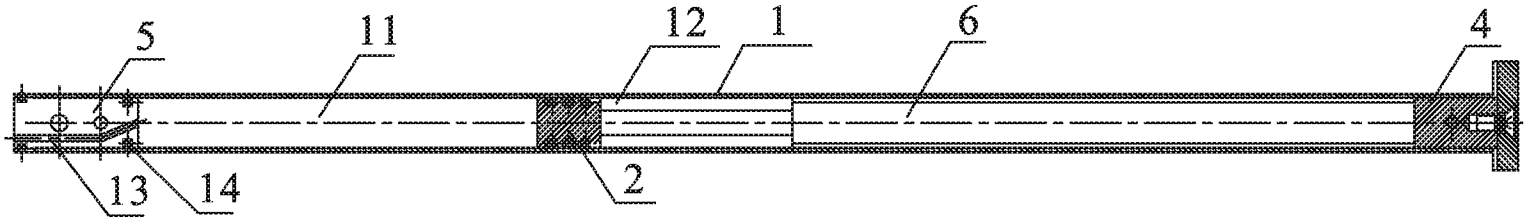
FIG. 1 is a sectional view of an air cylinder in accordance with Example 1 of the present disclosure.
Figure 2:
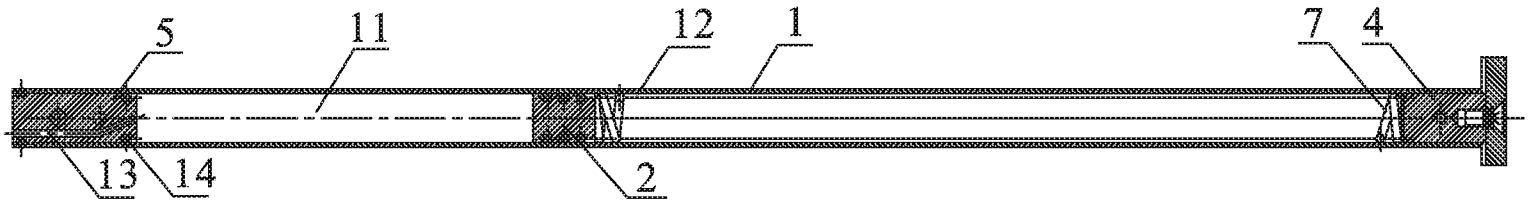
FIG. 2 is a sectional view of an air cylinder in accordance with Example 2 of the present disclosure.
Figure 3:
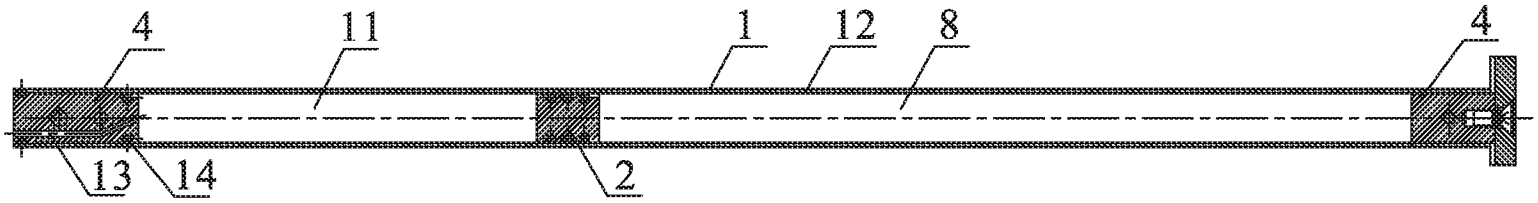
FIG. 3 is a sectional view of an air cylinder in accordance with Example 3 of the present disclosure.

As shown in FIG. 1, FIG. 2 and FIG. 3, an air cylinder for pneumatic guns is mounted on one side of a pneumatic gun barrel in parallel and comprises a cylinder body 1. The cylinder body 1 comprises a tubular air storage chamber, and a piston 2 is disposed in the air storage chamber and capable of axially sliding along the side wall of the air storage chamber. The piston 2 divides the air storage chamber into two independent cavities, that is, a first cavity 11 and a second cavity 12. An air charging hole 13 communicating with the first cavity 11 is formed in the upper end part of the cylinder body 1. The air charging hole 13 is used for injecting compressed air into a compressed air chamber of a pneumatic gun to fire bullets, and an elastic member is disposed in the second cavity 12 and is capable of continuously pushing the piston towards the first cavity.

In the present disclosure, the cylinder body 1 is a seamless steel tube, and a front connecting shaft 4 and a rear connecting shaft 5 are respectively arranged in two end tube openings of the cylinder body 1. An O-shaped seal ring 14 is arranged between the rear connecting shaft 5 and the side wall of the cylinder body 1. The piston 2, the cylinder body 1, the rear connecting shaft 5 and the O-shaped seal ring 14 collectively define the first cavity 11. The air charging hole 13 is disposed in the rear connecting shaft 5, the front connecting shaft 4 is tightly plugged in the cylinder body 1, and the front connecting shaft 4, the piston 2 and the cylinder body 1 collectively define the second cavity 12.

Example 1 as shown in FIG. 1: the elastic member is an air spring 6, one end of the air spring 6 abuts against the inner side of the front connecting shaft 4 at the bottom wall of the cylinder body 12, and the other end of the air spring 6 abuts against the piston 2.

Example 2 as shown in FIG. 2: the elastic member is a compression spring 7, one end of the compression spring 7 abuts against the inner side of the front connecting shaft 4 at the bottom wall of the cylinder body 12, and the other end of the compression spring 7 abuts against the piston 2.

Example 3 as shown in FIG. 3: the elastic member is compressed air 8, and the compressed air 8 is sealed in the second cavity 12.

A manufacturing procedure for the air cylinder for pneumatic guns, provided by the present disclosure, is as follows:

1. first designing a cylinder body (an air cylinder) made of a seamless steel tube;

2. designing a rear connecting shaft at the back of the seamless steel tube (the air cylinder), and designing an air charging hole (which is used for injecting air into the air cylinder);

3. designing a piston capable of sealing air at the middle part of the seamless steel tube (the air cylinder) to divide the air cylinder into two cavities capable of sealing the air;

4. designing a front connecting shaft at the front of the seamless steel tube (the air cylinder); and 5. designing a normal compression spring with a certain tension or injecting compressed air with a certain pressure or designing a standard air spring with a certain pressure between the piston and the front connecting shaft in the air cylinder, so that the piston can be pushed to lean against the inner side of the rear connecting shaft of the air cylinder, and thus a certain pre-pressure is formed.

Working Procedure:

1. at a natural state, the volume of the air cylinder between the rear connecting shaft and the piston is 0; when air is injected through the air charging hole in the rear connecting shaft of the air cylinder and the pressure reaches 80 bar (a preset value) and exceeds the pressure of the piston, the piston moves forwards; when the pressure is gradually increased, the piston moves forwards further to form a relatively larger air storage space, and at this time, the air can be exhausted to fire a bullet without needing of much more air injection; and 2. when continuous bullet firing is required, it only needs to continuously inject air through the air charging hole till a set maximum pressure is achieved, and at this time, and the piston will continuously move forwards to form a relatively larger air storage space, thereby achieving an effect of continuously firing the bullets for multiple time.

Due to the foregoing design, the saved energy of the compressed air in the air cylinder can be up to 20-30%, so that the practical efficiency of the compressed air in the air cylinder is largely improved.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An air cylinder for pneumatic guns, comprising a cylinder body; the cylinder body comprising:

a side wall;

an air storage chamber;

a piston capable of axially sliding along the side wall;

an air charging hole; and an elastic member;

wherein:

the piston is disposed in the air storage chamber and divides the air storage chamber into a first cavity and a second cavity;

the air charging hole communicates with the first cavity, and the elastic member is disposed in the second cavity and the elastic member is capable of continuously pushing the piston towards the first cavity;

the cylinder body is a seamless steel tube, a front connecting shaft and a rear connecting shaft are respectively arranged in two end tube openings of the cylinder body;

an O-shaped seal ring is arranged between the rear connecting shaft and the side wall of the cylinder body;

the piston, the side wall of the cylinder body, the rear connecting shaft, and the O-shaped seal ring collectively define the first cavity;

the air charging hole is formed in the rear connecting shaft; the front connecting shaft is plugged in the cylinder body; and the front connecting shaft, the piston, and the side wall of the cylinder body collectively define the second cavity.

2. The air cylinder of claim 1, wherein the elastic member is compressed air, and the compressed air is sealed in the second cavity.

3. The air cylinder of claim 1, wherein the elastic member is a compression spring, one end of the compression spring abuts against a bottom wall of the cylinder body, and the other end of the compression spring abuts against the piston.

4. The air cylinder of claim 1, wherein the elastic member is an air spring, one end of the air spring abuts against a bottom wall of the cylinder body, and the other end of the air spring abuts against the piston.

* * * * *